United States Patent [19]

Ciminelli

[11] Patent Number: 5,020,468

[45] Date of Patent: Jun. 4, 1991

[54] COMBINATION VEHICLE PARKING PLACE LOCATOR COIN AND KEYHOLDER

[76] Inventor: Joseph M. Ciminelli, 531 4th St., Struthers, Ohio 44471

[21] Appl. No.: 510,617

[22] Filed: Apr. 20, 1990

Related U.S. Application Data

[63] Continuation-in-part of Ser. No. 394,971, Aug. 17, 1989, abandoned.

[51] Int. Cl.[5] ..... G09F 11/00; A45C 1/00

[52] U.S. Cl. ..... 116/318; 116/309; 206/0.83

[58] Field of Search ..... 40/5, 27.5, 323, 330, 40/495; 116/306–309, 311, 312, 316, 318–320; 206/0.8–0.84, 37.1, 37.4, 38.1

[56] References Cited

U.S. PATENT DOCUMENTS

| | | | |
|---|---|---|---|
| 156,391 | 10/1874 | Thorp | 40/115 |
| 569,675 | 10/1896 | Seiler | 206/0.82 |
| 2,033,385 | 3/1936 | McCallum | 40/495 |
| 2,537,598 | 1/1951 | Mason | 116/308 |
| 2,553,257 | 5/1951 | Honeyman | 206/0.84 |
| 2,553,904 | 5/1951 | Eslick | 116/320 |
| 2,596,374 | 5/1952 | Crapster | 116/308 |
| 3,139,977 | 7/1964 | Burdick | 206/0.81 |
| 3,263,647 | 8/1966 | Murphy et al. | 116/308 |
| 3,285,459 | 11/1966 | Gahm | 116/308 |
| 3,460,508 | 8/1969 | Baxter | 116/317 |
| 3,604,233 | 9/1971 | Barrett | 70/459 |
| 3,763,820 | 10/1973 | Sage | 40/330 |
| 4,166,489 | 9/1979 | Lemelson | 206/38.1 |
| 4,224,894 | 9/1980 | Haldeman | 116/209 |
| 4,432,300 | 2/1984 | Lyss | 116/308 |
| 4,680,882 | 7/1987 | Watson, Jr. | 40/5 |

FOREIGN PATENT DOCUMENTS

| | | | |
|---|---|---|---|
| 1511150 | 9/1978 | Fed. Rep. of Germany | 40/323 |
| 1021997 | 2/1953 | France | 40/113 |
| 1166645 | 11/1958 | France | 116/318 |

*Primary Examiner*—William A. Cuchlinski, Jr.
*Assistant Examiner*—W. Morris Worth

[57] ABSTRACT

The device comprises two circular discs each having indicia and an arrow on each outer surface and on each inner surface having a c-shaped wall with an opening and a central body having front and back faces, each face provided with an arrow located centrally of and adjacent to an opening of a c-shaped wall extending from each face of the body. The c-shaped wall of each disc is designed to be inserted into each c-shaped wall on the central body, also each c-shaped wall of each disc is provided with a frictional element to hold the assembled device together when the discs are rotatably mounted to the body, this frictional element also serves as a locking element after manual rotation of the discs for the alignment of any selected indicia or arrow on the outer surface of each disc with the arrow on the central body. Once the device is assembled two coinholders exist, one on the front face of the body and the other on the back face of the body. The insertion of a coin into or removal from each coinholder is provided by the alignment of the arrow of each disc with the arrow on the body, this alignment of arrows aligns the openings of the c-shaped walls of each disc with the openings in the c-shaped walls on the body.

5 Claims, 1 Drawing Sheet

COMBINATION VEHICLE PARKING PLACE LOCATOR COIN AND KEYHOLDER

This is a continuation in part of Ser. No. 07,394,971 filed 08/17/89, abandoned, for TRIPLE PURPOSE DEVICE USED FOR LOCATING PARKING PLACE OF A VEHICLE AND AS A COIN AND KEYHOLDER.

BACKGROUND OF THE INVENTION

This invention relates to a device having symbols to locate the parking place of a vehicle and structured to also embody a coinholder detachably connected to ignition keys of a vehicle comprising a body having a C-shaped wall with an opening and an arrow on each face of said body and further comprising two discs each having symbols and an arrow on the outer face and on the face opposite each having a C-shaped wall with an opening, said C-shaped wall of each said disc designed smaller than each said C-shaped wall on said body may be inserted into the said larger C-shaped wall thus the discs are rotatably mounted on to said body, furthermore, on the outer wall portion of each said smaller C-shaped wall are three pairs of resilient projections protruding from said outer wall portion and said resilient projections exerting enough pressure within the said larger C-shaped wall of said body to serve as a frictional locking means for any selected symbol or arrow during rotation of said discs and also to frictionally hold the said discs on to said body and once said discs are rotatably mounted on to opposite faces of said body they lie parallel to one another and rotate independently of one another in either direction. Once the said discs are mounted on to opposite faces a receptacle for coins is formed on each face of said body.

Large congested parking lots in malls at sporting events and parking decks can be confusing in locating a parked vehicle resulting in loss of time and energy. A driver of a vehicle needing coins for a parking meter or pay telephone when no coins are readily available is in difficult straits.

SUMMARY OF THE INVENTION

It is an object of this invention to provide a device for indicating to a symbol representing the location of a parking place of a vehicle which is detachably connected to ignition keys of a vehicle by means of which device this confusion can be overcome and to provide coins for the driver of a vehicle in difficult straits for the need of coins at parking meters or pay telephone booths. Such a device should be lightweight, low in cost and simple to operate.

These objects are achieved by a device for indicating a symbol representing the location of a parking place and to provide coins in situations as mentioned above characterized by a body having a C-shaped wall with an opening and an arrow on each face of said body and further comprising two discs each having symbols and an arrow on the outer face and on the face opposite each having a shallow band with an opening, said C-shaped wall of each said disc designed smaller than each said C-shaped wall on said body may be inserted into the said larger C-shaped wall thus the discs are rotatably mounted on to said body, furthermore on the outer wall portion of each said smaller C-shaped wall are three pairs of resilient projections protruding from said outer wall portion and said resilient projections exerting enough pressure within the said larger C-shaped wall of said body to serve as a frictional locking means for any selected symbol or arrow during rotation of said discs and also to frictionally hold the said discs on to said body and once said discs are rotatably mounted on to opposite faces of said body they lie parallel to one another and rotate independently of one another in either direction and as each said disc rotates a receptacle for coins exists within the confines of a volume of space beneath the underface of each said disc and the face of the body beneath multiplied by the circumference of said C-shaped wall of said disc. Furthermore since each said disc rotates the opening of each said C-shaped wall of each said disc may be aligned with the opening of the stationary C-shaped wall on said body at a certain exact point and at this said point the arrow on the said disc is aligned with the arrow on the body and now at this said point a coin may be inserted in to or retrieved from said coinholder, once the said disc is rotated beyond said alignment of arrows any coin within the coinholder will remain inside said coinholder.

DETAILED DESCRIPTION OF THE PREFERRED EMBODIMENT

Figure 1:
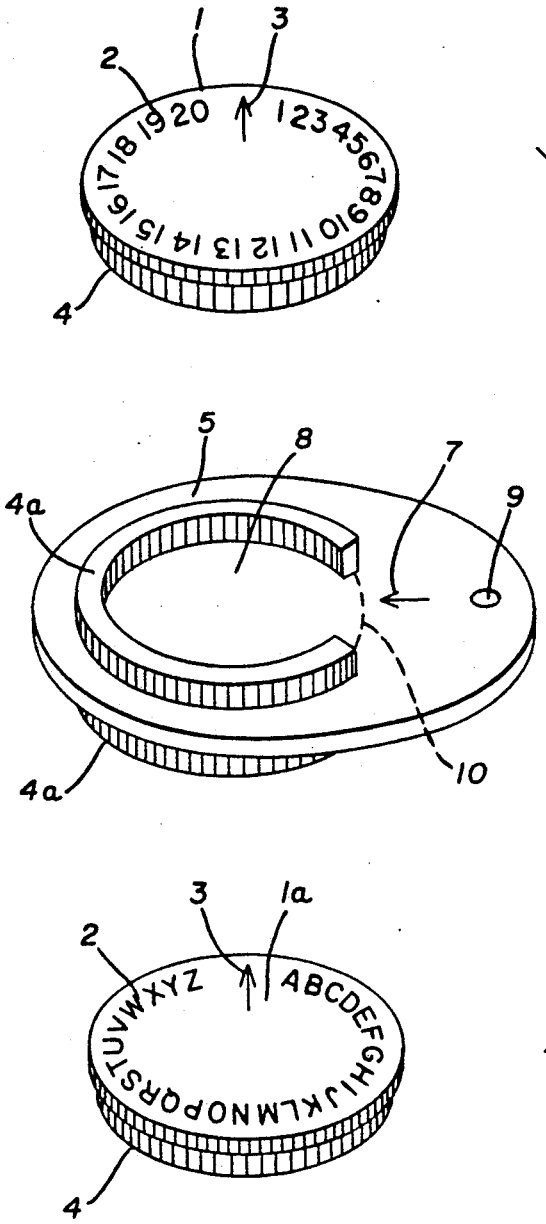
FIG. 1 shows a view of the outer face of discs 1 and 1*a* and a partial view of the C-shaped wall 4 on the face opposite.

The device for indicating symbols to locate the parking place of a car and also structured to embody a coinholder can be seen in FIG. 1 which illustrates two identical discs 1 and 1*a* and the body 5. Disc 1 is shown with a partial view of the C-shaped wall 4 on the face opposite the outer face and on the outer face are shown an arrow 3 and the symbols 2 which are letters of the alphabet A through Z encircling its circumference. Disc 1*a* is identical to disc 1 in all aspects except that the symbols 2 are numerals 1 through 20 encircling its circumference. Also in FIG. 1 is the body 5 with the arrow 7 on its face, the C-shaped wall 4*a* with its opening 10 and within the confines of the C-shaped wall 4*a* is the area 8 which receives coins inserted through opening 10 also a bore 9 is provided for insertion of a key chain to hold ignition keys of a vehicle.

Figure 2:
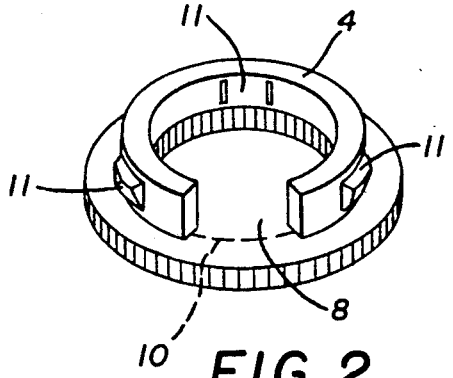
FIG. 2 shows a view of the discs 1 and 1*a* showing the C-shaped wall 4 with an opening on the face opposite the outer face.

FIG. 2 is a view of the C-shaped wall 4 on the underface of each disc. Projecting from the outer wall portion of the C-shaped wall 4 are shown the three resilient protrusions 11 which frictionally hold the discs to the body and also serve as a locking means for holding in place any selected symbol or arrow during rotation of the discs.

Figure 3:
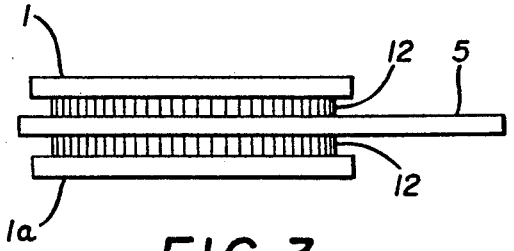
FIG. 3 is a side view of the assembled device.

FIG. 3 is a side view of the assembled device with the discs 1 and 1*a* rotatably mounted on to opposite faces of the body 5. Referring to FIG. 2 the C-shaped wall 4 of each disc is smaller in circumference than the C-shaped wall 4*a* on the body 5 seen in FIG. 1 and when the smaller C-shaped wall 4 is inserted into the C-shaped wall 4*a* the resilient protrusions 11, seen in FIG. 2 exert the frictional pressure necessary to hold the discs 1 and 1*a* on to the body 5, this frictional pressure also locks in place any selected symbol or arrow during rotation of either disc.

Once the device is assembled as seen in FIG. 3 it now embodies two coinholders 12. Each coinholder comprises the volume of space beneath the face of each disc 1 and 1*a* and each face of the body 5. Now referring to FIG. 1 when the arrow 3 on either disc 1 and 1*a* is aligned with the arrow 7 on the body 5 the opening 10 of either disc is now aligned with the opening 10 on the body 5 and it is at this alignment of arrows that coins may be inserted into or retrieved from the coinholder.

Referring to FIG. 1 the arrow 7 on the body 5 is the arrow to which any selected symbol or arrow may be aligned. FIG. 1 shows the symbols 2 and the arrows 3 on both discs 1 and 1*a*. When either disc is rotated a selected symbol is aligned with the arrow 7 on the body 5 and it is this symbol which refers to the location of a parked vehicle.

With the device attached to the ignition keys, the driver, when parking the vehicle, observes the symbols representing the parking place and removing the keys from the ignition switch has immediately available the device to record the symbols representing the parking place. In using the device the driver manually rotates the letter on one face and the number on the other face indicating the parking place of the vehicle. Returning to the parking area the driver simply observes on the device the letter and number indicating the parking place.

Since the device is also a coinholder the driver has always available coins for parking meters, telephone booths or other emergency situations. The device is a simple, lightweight, low cost plastic product useful for any driver of a vehicle.

What is claimed is:

1. A combination vehicle parking place locator, coin and key holder comprising;

a central body having a front and back faces, a C-shaped wall extending from each said face, first index means located centrally of and adjacent to an opening in the C-shaped wall of each said face, and means for attaching a key chain to said body;

first and second circular discs, each of said disc having inner and outer surfaces, the inner surface of each said disc includes a C-shaped wall with an outer diameter that is smaller than an inner diameter of the C-shaped walls of said body so as to be rotatably mounted within one of said C-shaped walls of said body, the outer surface of each said disc having indicia and a second index means thereon, said second index means being aligned centrally of an opening in the C-shaped wall on the inner surface of each said disc;

a coin holder on opposite sides of said body defined by one of the faces of said body, the inner surface of one of the discs and their respective C-shaped walls, whereby manual rotation of said discs to cause alignment of said first index means with said second index means aligns the openings in the C-shaped walls of the body and discs so as to permit the insertion and removal of a coin therethrough said openings;

means for frictionally securing said discs to said body, whereby the discs may be manually rotated to selectively align the indicia of each disc with respective first index means on the faces of said body to designate a vehicle's location in a parking area.

2. The device according to claim 1, wherein the indicia on said first disc is in the form of letters of the alphabet from A through Z placed adjacent the perimeter of the outer surface of said first disc, the indicia on said second disc is in the form of numerals 1 through 20 placed adjacent the perimeter of the outer surface of said second disc, and said first and second index means are in the form of arrows.

3. The device according to claim 1, wherein the frictionally securing means is in the form of protrusions spaced along an outer wall portion of the C-shaped wall of each disc for respective frictional engagement of an inner wall portion of the C-shaped wall of each face of said body.

4. The device according to claim 1, wherein each said disc is made of a resilient light-weight plastic.

5. The device according to claim 1, wherein the attaching means is in the form of a bore through said body for receiving said key chain.

* * * * *